United States Patent [19]

Fischer et al.

[11] Patent Number: 4,747,214

[45] Date of Patent: May 31, 1988

[54] SAW CHAIN FOR A MOTOR-DRIVEN CHAIN SAW

[75] Inventors: Manfred Fischer, Asperg; Klaus Dussler, Weinstadt; Wilfried Linke, Winnenden; Werner Hartmann, Ostfildern, all of Fed. Rep. of Germany

[73] Assignee: Andreas Stihl, Waiblingen, Fed. Rep. of Germany

[21] Appl. No.: 114,557

[22] Filed: Oct. 29, 1987

[30] Foreign Application Priority Data

Nov. 29, 1986 [DE] Fed. Rep. of Germany ..... 3640871

[51] Int. Cl.[4] ..... B27B 17/04

[52] U.S. Cl. ..... 30/384; 83/833

[58] Field of Search ..... 30/384, 385, 383; 83/830–835, 820

[56] References Cited

U.S. PATENT DOCUMENTS 4,387,615 6/1983 Lemery ..... 83/833 X 4,573,386 3/1986 Lindemann et al. ..... 83/833

4,593,591 6/1986 Beerens ..... 83/834

*Primary Examiner*—Douglas D. Watts

*Attorney, Agent, or Firm*—Walter Ottesen

[57] ABSTRACT

With motor-driven chain saws, there is the danger that the chain saw will be thrown upwardly and rearwardly when it is applied to wood by the user with a forward thrust. Serious injuries can then occur. The invention is directed to a saw chain which is so configured that the cutting forces are automatically reduced in response to the occurrence of excessive reaction forces so that the reaction force is immediately reduced to a tolerable amount thereby eliminating the kickback effect. The drive links of the saw chain which engage into the nose sprocket of the guide bar are so dimensioned that they can further pivot in the tooth gaps of the nose sprocket out of their normal position and, in this way, take the cutting links with them in such a manner that the free angle $\alpha$ of the cutting teeth is reduced.

11 Claims, 6 Drawing Sheets

SAW CHAIN FOR A MOTOR-DRIVEN CHAIN SAW

FIELD OF THE INVENTION

The invention relates to a saw chain for a motor-driven chain saw equipped with a guide bar. The saw chain includes cutting links, connecting links and drive links which are interconnected to provide an endless chain. The guide bar has a nose sprocket for the saw chain rotatably mounted on the front end thereof. The nose sprocket has a plurality of teeth and each two mutually adjacent ones of the teeth have adjacent tooth flanks conjointly defining a tooth gap for accommodating the drive links therein.

BACKGROUND OF THE INVENTION

The saw chain described above includes a depth limiter which is formed on the cutting links and which limits the depth of cut into the wood. Reaction forces can develop while cutting into soft wood and/or with a sudden intensely increasing thrust force which is produced by the operator. These reaction forces can lead to the chain saw being thrown back which is generally known as kickback. The chain saw can be kicked back upwardly and rearwardly and can cause serious injury. Accordingly, many ways have been sought by means of which this danger of accident can be prevented.

SUMMARY OF THE INVENTION

It is an object of the invention to so configure the saw chain that the kickback effect is substantially eliminated when an excessive reaction force is directed against the saw chain.

According to a feature of the invention, the drive links are so configured and supported that a pivoting of these links in the tooth gaps is possible with each cutting link, which follows the drive link corresponding thereto, being pivoted in such a manner that the free angle of the saw tooth roof is reduced. The free angle can be also reduced to zero or even be made negative. In this way, the cutting forces and therefore the reaction forces are reduced which could cause a kickback of the chain saw. The drive links of the saw chain according to the invention are adapted to the tooth flanks of the nose sprocket such that after the drive links are pivoted, a fitted seat results which works against a return pivoting into the starting position and so holds the drive links in their position until they leave the nose sprocket.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
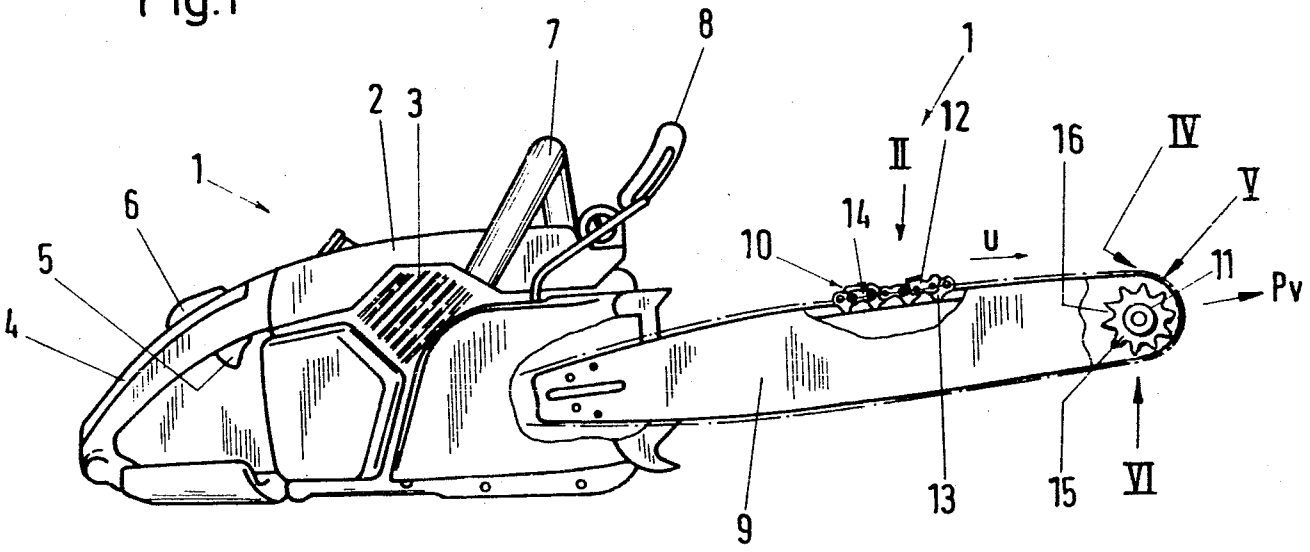
FIG. 1 is a side elevation view of a portable motor-driven chain saw having a guide bar and a saw chain mounted on the latter.

The motor-driven chain saw 1 shown schematically in FIG. 1 includes a housing 2 which encloses a drive motor 3 which in this embodiment is an internal combustion engine. The rear handle 4 is attached to the housing 2. A gas lever 5 and a gas lever latch 6 are mounted on the handle 4. In addition, a forward bail handle 7 is provided in front of which a hand guard 8 is mounted. A guide bar 9 extends forwardly from the housing 2 on which a continuous saw chain 10 is guided and driven by the drive motor 3 in the direction of arrow U around the guide bar.

A nose sprocket 11 for the saw chain 10 is rotatably journalled on the forward end of the guide bar 9. As can be especially seen in FIGS. 2 and 3, the saw chain includes cutting links 12, drive links 13 and connecting links 14 which are pivotally interconnected. The drive link 13 engages in the tooth gaps 16 (FIGS. 4 and 5) between the teeth 15 of the nose sprocket 11.

Figure 2:
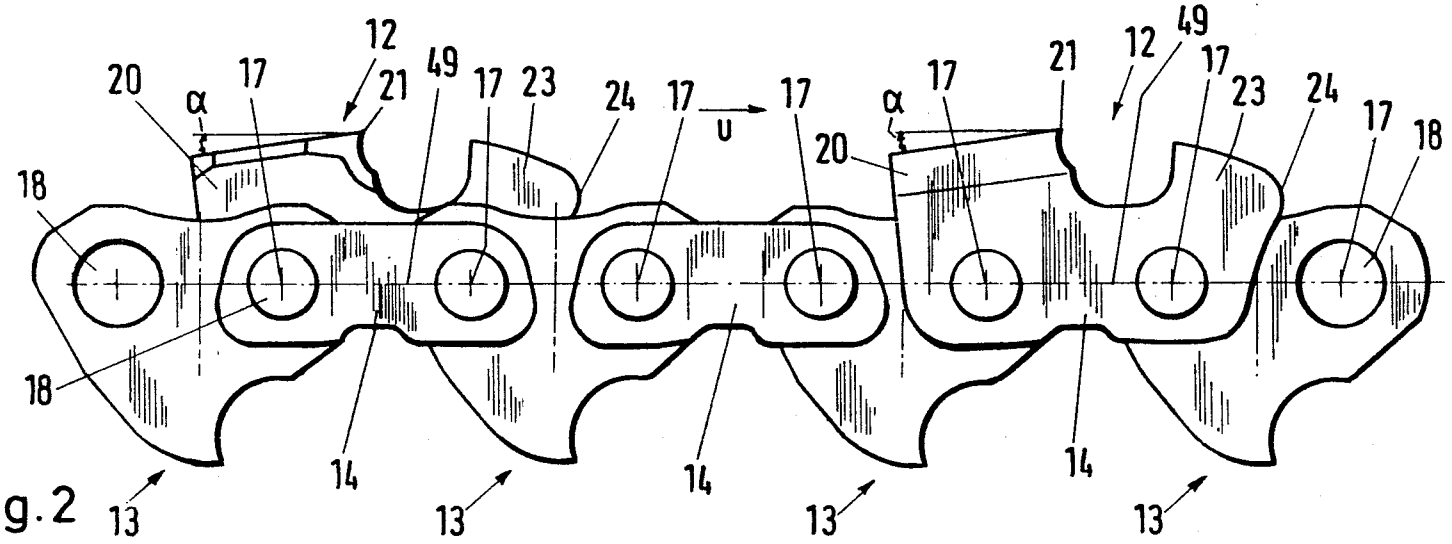
FIG. 2 is an enlarged side elevation view of the saw chain drawn in the region II of FIG. 1.
Figure 3:
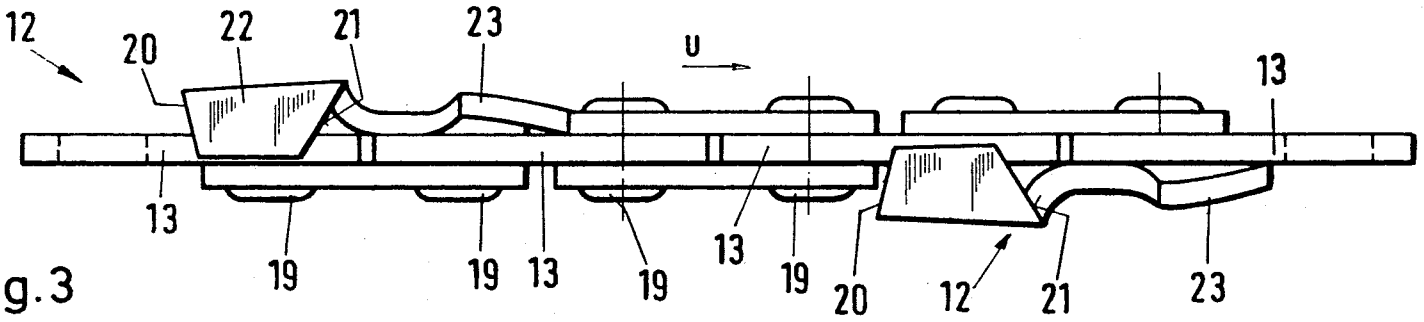
FIG. 3 is a plan view of the portion of the saw chain shown in FIG. 2.

All chain links 12, 13 and 14 each have two pivot axes 17 which are defined by rivet pins 19. The pivot axes 17 lie one behind the other when viewed in the direction of movement of the chain and are spaced from each other. The rivet pins 19 extend through corresponding bores 18 of the chain links and pivotally connect the chain links which are arranged one behind the other. As shown in FIGS. 2 and 3, the spacing between the pivot axis 17 on the drive links 13 is smaller than on the cutting links 12 and on the connecting links 14. The cutting links 12 and the connecting links 14 are configured as side links in the embodiment shown; whereas, the drive links 13 are center links which are disposed between two connecting links or between a cutting link 12 and a connecting link 14.

In its rearward region, the cutting link 12 extends upwardly to a cutting tooth 20 which is bent over transversely to the plate-like body of the cutting link and which has a cutting edge 21 at its forward end viewed in the direction of movement U. The saw tooth 20 is inclined toward the rear starting from the cutting edge 21 so that a free angle $\alpha$ is formed. The magnitude of the free angle is approximately 5° to 10° and is preferably approximately 7°. This magnitude enables a high cutting capacity to be achieved and nonetheless substantially eliminates the kickback effect in combination with the arrangement according to the invention.

An upwardly projecting depth limiter 23 is formed on the forward portion of the cutting link 12 and is inclined somewhat with respect to the plate-like body of the cutting link as shown in FIG. 3. The depth limiter 23 is arranged ahead of the saw tooth 20 and is spaced therefrom. The depth limiter 23 is so configured that its rounded forward edge 24 extends over the center region of the drive link 13 in the direction toward the latter's forward pivot axis 17.

The saw chain 10 can be configured as a low-profile chain. In such a chain, the distance between the pivot axes 17 of the cutting link 12 along the connecting line 49 is greater than the height of the tooth which is defined by the largest spacing of the cutting edge 21 to the plane containing the connecting line 49. The cutting edge 21 is the point of force engagement for the cutting and reaction forces. The tooth roof 22 with the cutting edge 21 is sloped transversely to the direction of movement and therefore likewise has a free angle in this direction so that the spacing of the cutting edge 21 to the plane containing the connecting line 49 is not constant along the cutting width. The cutting tooth can also be configured differently and, for example, can have a rearward increase in elevation (when viewed in the direction of movement) as well as other projections, recesses, sloped portions and the like. The saw chain 10 is characterized as a low-profile chain if the proportion of the above-mentioned spacings is the same or greater than 1.1, that is, the spacing between the pivot axes 17 is at least one tenth greater than the largest elevation of the saw tooth 20 measured between the plane containing the connecting line 49 and the cutting edge 21.

The drive link 13 engages the tooth gap 16 of the nose sprocket 11 and, as seen in FIGS. 4 to 8, has two flanks 25 and 26. Forward flank 25 viewed in the direction of movement U of the chain lies at the rearward tooth flank 27 of the forward tooth 15 referred to the direction of movement U of the saw chain; whereas, the rearward flank 26 of the drive link 13 lies against the forward tooth flank 28 of the rearward tooth 15 viewed in the direction of movement U.

Figure 7:
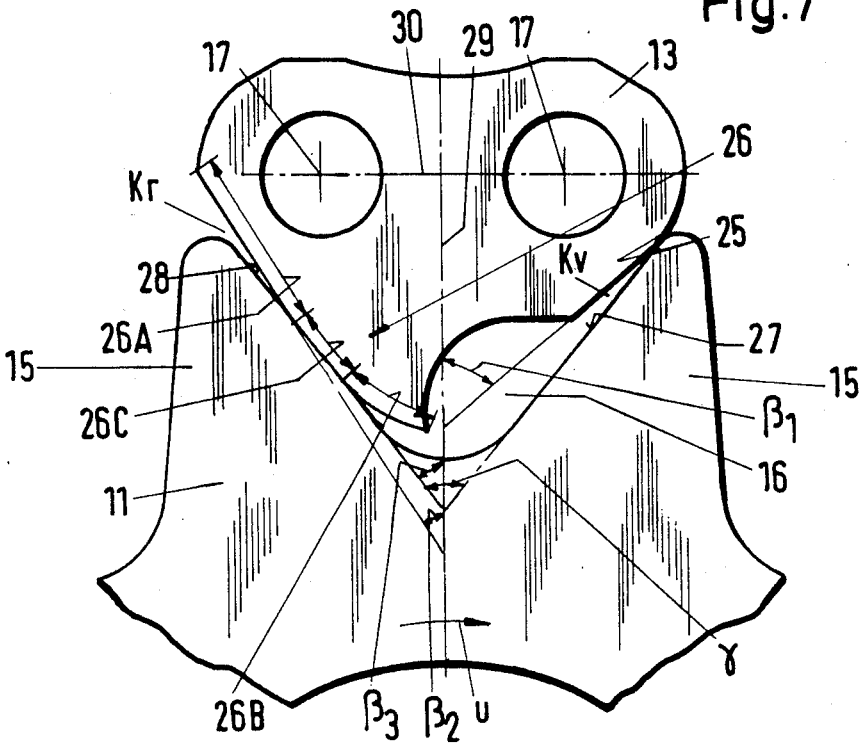
FIG. 7 shows a drive link of the saw chain engaged with the nose sprocket for the condition of normal load; and, FIG. 8 shows the drive link of FIG. 7 in the pivoted position caused by the additional load associated with the forward thrust.

The tooth gap 16 shown in FIG. 7 is defined by the two tooth flanks 27 and 28. The opening angle $\gamma$ of the tooth gap 16 is approximately 80° in the embodiment shown; however, it can also be less or greater. As shown especially in FIG. 7, the rearward flank 26 of the drive link 13 has an outer linear section 26A and an inner section 26B which is convexly curved. The two flank sections 26A and 26B are connected by a linear flank section 26C with the transition between the flank sections being continuous.

Referring to FIG. 7, the line 29 runs centered between the pivot axes 17 and perpendicularly intersects the connecting line 30 of the two axes 17 and so defines the center perpendicular to the line 30. The drive link 13 is configured so as to be unsymmetrical with respect to line 29 in such a manner that the forward flank angle $\beta_1$ formed between the partition line 29 and the forward flank 25 is greater than the rearward flank angle $\beta_2$ which is included between the flank section 26A and partition line 29 with the sum of the flank angles $\beta_1$ and $\beta_2$ being equal to the opening angle $\gamma$ of the tooth flanks 27 and 28 which in this embodiment is 80°. The angle $\beta_1$ can, for example, be 50° and the angle $\beta_2$ can be 30°. Since the inner flank section 26B of the rearward flank 26 of the drive link 13 is convex, lines tangent to the section 26B each form an angle with the partition line 29 which is greater than $\beta_2$. The section 26C of the flank 26 of the drive link follows (in the position shown in FIG. 7) the course of the tooth flank 28 and defines an angle $\beta_3$ with the partition line 29 which is 40° in the embodiment shown. The ratio between the angle $\beta_1$ and $\beta_2$ can be 1.1:1 to 1.4:1 and is 1.25:1 in the embodiment shown with the angle $\beta_3$ being equal to half of the opening angle $\gamma$ of the tooth flanks 27 and 28.

The configuration described above makes it possible to reduce the reaction forces occurring with the forward thrust of the chain saw to the extent that the danger of a throwback of the saw, that is the kickback effect, is substantially prevented.

Figure 4:
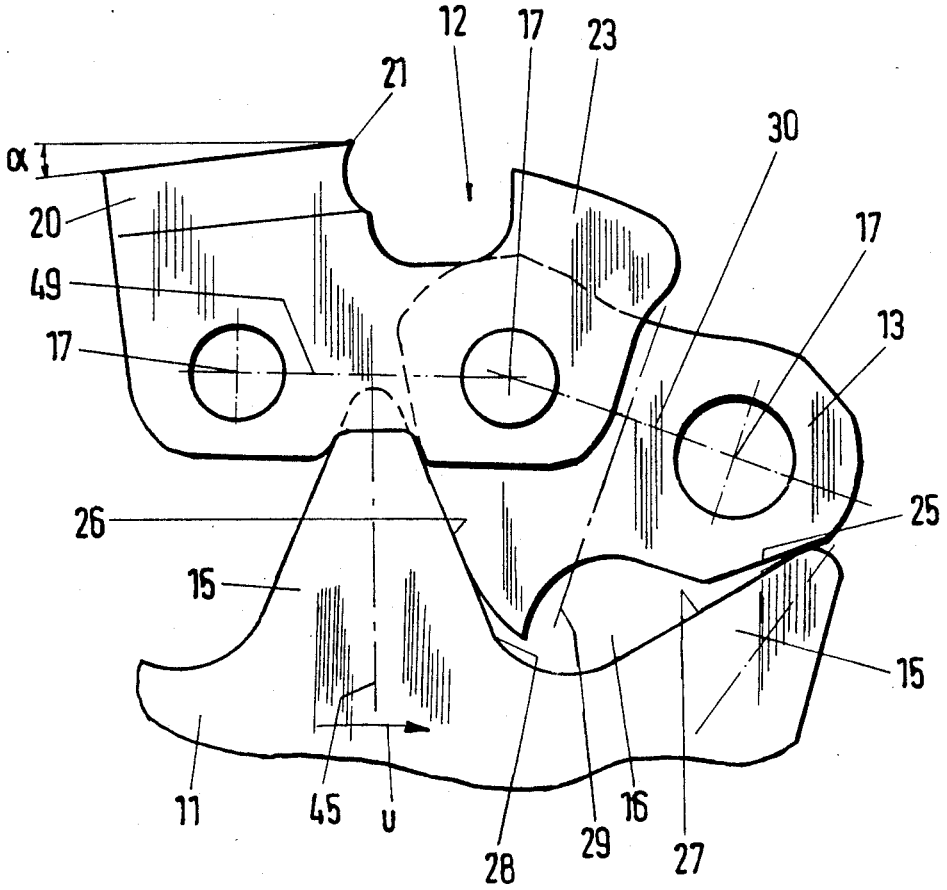
FIG. 4 is an enlarged side elevation view of a segment of the saw chain in the region IV of FIG. 1 as it enters onto the nose sprocket.

The chain links have the position shown in FIGS. 2 and 4 when the saw chain 10 is loaded only with the pulling forces caused by the drive. In this position, the roof 22 of the saw tooth 20 is inclined to the cutting edge 21 such that the normal free angle $\alpha$ is present. When entering the nose sprocket 11 (FIG. 4), the cutting link 12 and the drive link 13 which is ahead of the latter are so aligned that the connecting line 49 is perpendicularly and centrally intersected by the line bisecting the tooth 15 and the connecting line 30 is perpendicularly and centrally intersected by the line bisecting the gap 16. Accordingly, as shown in the side elevation view of FIG. 4, the connecting line 49 intersects the radial symmetrical plane 45 of the nose sprocket tooth 15 at right angles. For this condition, the drive link 13 is with its forward flank 25 in approximate point contact engagement with the tooth flank 27 as seen in side elevation (FIGS. 4 and 7); whereas, the rearward drive link flank 26 is with its center straight line section 26C in surface contact engagement with the forward flank 28 of the corresponding tooth 15.

A wedge gap Kv is present between the flank 25 of the drive link 13 and the flank 27 of the leading tooth 15, the wedge gap Kv opening in the direction toward the tooth gap 16. The other drive flank 26 and the tooth flank 28 with which it is in contact likewise define a wedge gap Kr which, however, opens outwardly (FIG. 7) starting from the contacting surface of the flank section 26C with the tooth flank 28.

Figure 5:
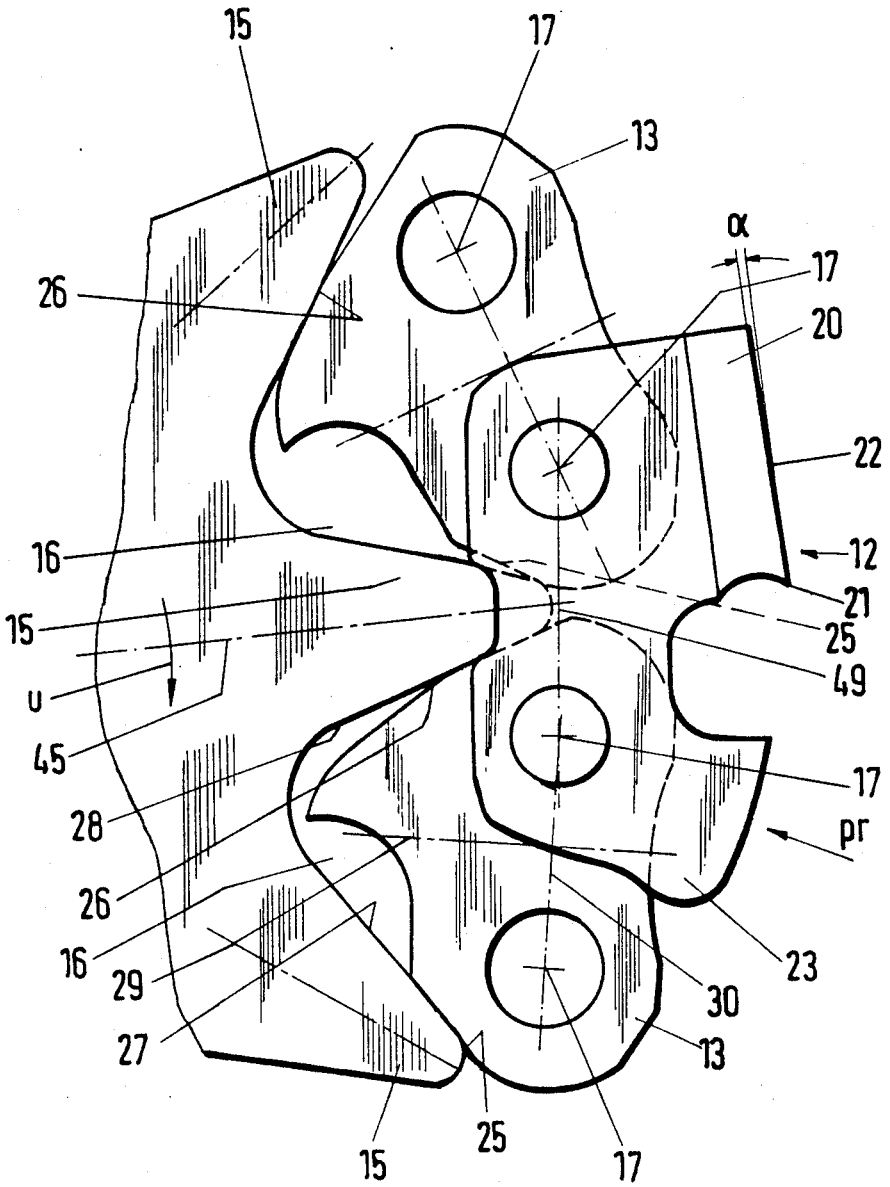
FIG. 5 is an enlarged side elevation view of a portion of the saw chain region V of FIG. 1 wherein the saw tooth is pivoted as a consequence of a reaction force from the forward thrust acting against the chain.
Figure 6:
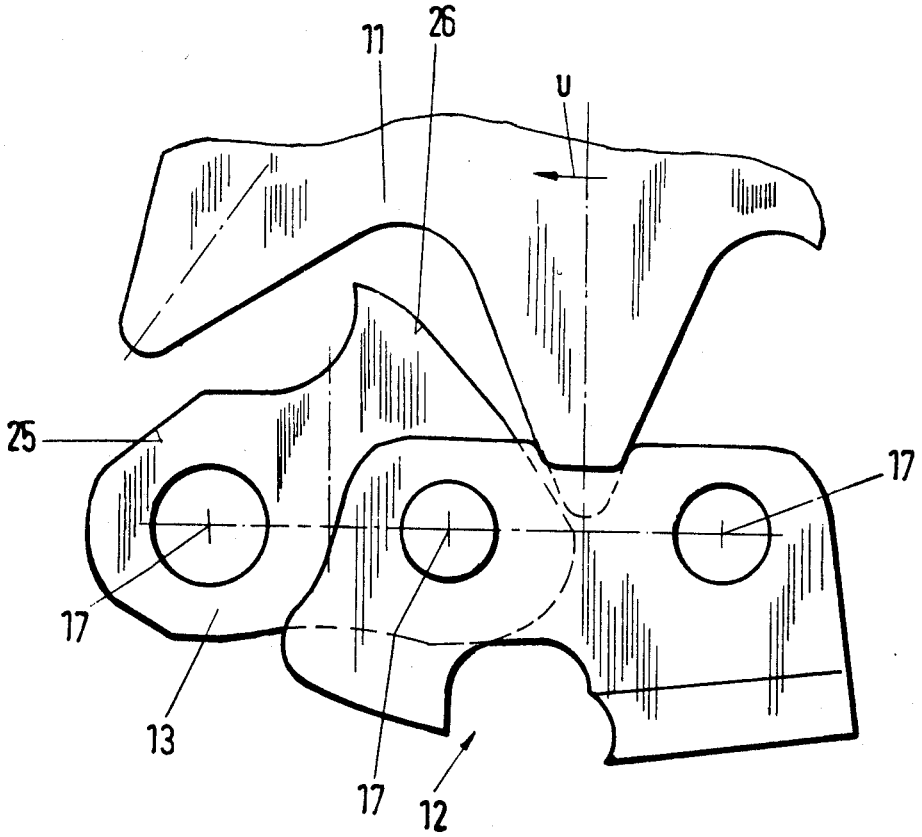
FIG. 6 is an enlarged side elevation view of a portion of the saw chain in region VI of FIG. 1.
Figure 8:
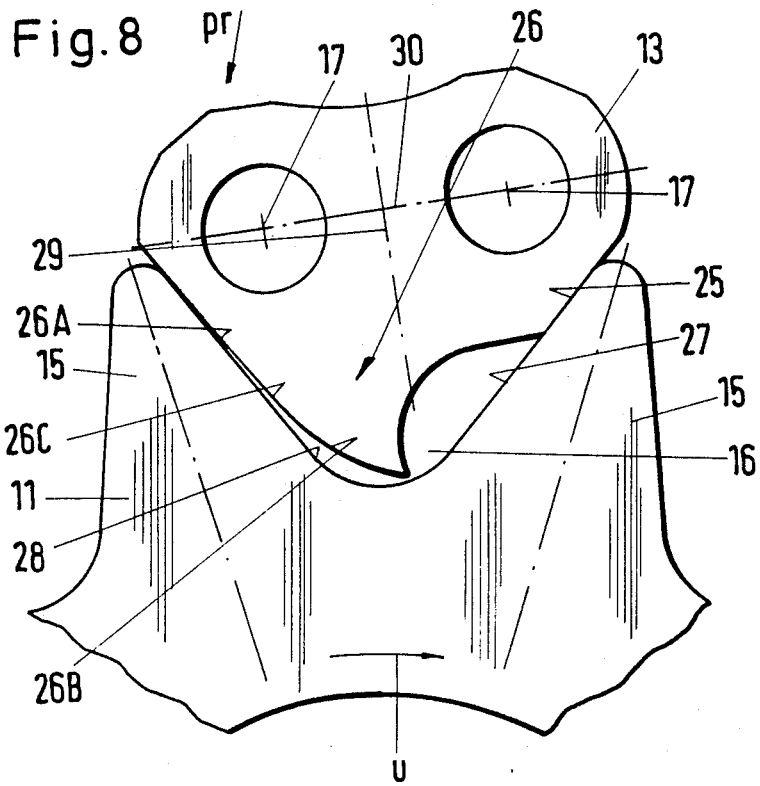

When the guide bar 9 with the moving saw chain 10 is guided into the wood to be cut, a reaction force Pr results as a consequence of the forward thrust Pv (FIG. 1) required for this purpose. The reaction force Pr is also dependent upon the cutting force and acts with a component pr on the depth limiter in the direction of the arrow indicated by pr shown in FIG. 5, the depth limiter being shown entering the nose sprocket. With this component pr, the forward running drive link 13 pivots in the tooth gap 16 and this pivoted-in position of the drive link is shown in FIG. 8 and is shown in FIG. 5 for the forward drive link 13.

The diving of the drive link into the tooth gap 16 is facilitated by the two wedge gaps Kv and Kr which are thereby closed so that the forward drive flank 25 is in surface contact engagement with tooth flank 27 and so that the section 26A of the rearward drive link flank 26 is in surface contact engagement with the tooth flank 28. As FIG. 5 shows, the connecting pivot axis 17 of the drive link 13 with the cutting link 12 is displaced inwardly in the direction toward the tooth gap 16 with the pivoting-in of the drive link 13. This causes the cutting link 12 to also pivot so that the saw tooth 20 with its roof 22 is positioned so as to be less steep with respect to the path traced by the cutting edge 21; thus, the free angle $\alpha$ is reduced and can become zero or even negative. In this way, the cutting force is reduced so that the reaction force Pr is also reduced which is responsible for the kickback. Therefore, the reduction of the free angle $\alpha$ eliminates or reduces the danger of kickback.

In the pivoted-in position, the connecting line 30 of the drive link 13 and also the connecting line 49 of the cutting link 12 are inclined to the corresponding radials of the nose sprocket 11 which define the angular bisecting lines of the tooth gap 16 and tooth 15, respectively.

The cutting link 12 has the tendency to pivot back into its starting position (FIG. 4) as a consequence of the force acting on the cutting edge 21. However, a return pivoting in the nose sprocket region of the guide bar 9 would make the intended assurance against kickback ineffective. The drive links 13 are therefore so configured that they have a self-holding function in their pivoted-in position until they leave the nose sprocket 11.

This self-holding function is achieved in the embodiments of FIGS. 4 to 8 by means of the configurations described since the surface contact engagement of both drive-link flanks 25 and 26A on the corresponding tooth flanks constitute a latch against a return pivoting of the drive link. This latch is first released when the drive link leaves the nose sprocket since both drive-link flanks lift away from the tooth flanks of the nose sprocket (FIG. 6) when the saw chain enters the straight line guide of the bar 9.

An essential advantage of the saw chain according to the invention is that the free angle of the saw teeth is reduced only in the region of the nose sprocket when the reaction forces suddenly increase intensely and therefore threaten a kickback, that is a throwback of the chain saw. Therefore, the reduction of the free angle occurs only sporadically so that the cutting capacity of the saw, which is dependent upon the free angle, is reduced only slightly overall.

It is understood that the foregoing description is that of the preferred embodiments of the invention and that various changes and modifications may be made thereto without departing from the spirit and scope of the invention as defined in the appended claims.

What is claimed is:

1. A saw chain for a motor-driven chain saw having a housing with a guide bar mounted thereon, the guide bar having upper and lower edges and a nose sprocket journalled at its forward end so as to be freely rotatable, the sprocket having a plurality of teeth and each two mutually adjacent ones of said teeth having respective adjacent tooth flanks conjointly defining a tooth gap having an opening angle $\gamma$, the saw chain comprising:

a plurality of links interconnected by rivet pins or the like to form an endless saw chain guided on said guide bar on said edges and on said nose sprocket;

a first portion of said links being cutting links and a second portion of said links being drive links;

each one of said cutting links including: a plate-like cutting-link body having an upwardly extending rearward portion defining a cutting tooth; a forward upwardly extending portion defining a depth limiter; a forward bore opening for accommodating one of said rivet pins therein to define a forward cutting-link pivot axis; and, a rearward bore opening for accommodating an other one of said rivet pins therein to define a rearward cutting-link pivot axis;

each one of said drive links being a plate-like body having a forward bore and a rearward bore for accommodating two of said pins to define respective forward and rearward drive-link pivot axes;

each one of said cutting links being pivotally connected with a forward drive link directly forward thereof so that the rearward drive-link pivot axis of the latter is coincident with said forward cutting-link pivot axis and each one of said cutting links also being pivotally connected with a rearward drive link directly rearward thereof so that the forward drive-link pivot axis of the latter is coincident with said rearward cutting-link pivot axis;

each one of said drive links being configured to engage one of said tooth gaps when entering said nose sprocket and having two downwardly extending drive-link flanks for contact engaging corresponding ones of said tooth flanks of said tooth gap, one of said drive-link flanks being a forward drive-link flank and the other one of said drive-link flanks being a rearward drive-link flank;

said cutting link being atop one of the teeth of said nose sprocket in a first orientation with said forward and rearward drive links being in corresponding tooth gaps on opposite sides of said tooth;

said cutting tooth having a tooth roof extending rearwardly from said cutting edge thereof to define a free angle with a tangent to the circle traced by said cutting edge as the latter moves around the forward end of said guide bar, said free angle being determinative of the cut into wood for said first orientation;

at least one of said drive-link flanks of each of said drive links having a contour different from the contour of said tooth flanks and said one drive-link flank of said drive link being so configured that said drive link with a section of its forward drive-link flank contact engages the tooth flank corresponding thereto so as to be pivotally movable within said tooth gap from a normal first position of said drive link corresponding to said first orientation of said cutting link to a second position in response to a reaction load applied to the saw chain wherein said cutting link is shifted to a second orientation on said one tooth in which the magnitude of said free angle is reduced thereby reducing or eliminating kickback.

2. The saw chain of claim 1, said one drive-link flank being the rearward one of said drive-link flanks viewed in the direction of movement of the saw chain, said one drive-link flank being partitioned into at least two flank sections having respectively different flank angles referred to a partition line of said drive link perpendicular to a connecting line passing through said drive-link pivot axes.

3. The saw chain of claim 2, said forward and rearward drive-link flanks extending downwardly toward the lowermost point of the drive link, a first flank section of said two flank sections being disposed outermost away from said lowermost point, said first flank section and said partition line conjointly defining a flank angle $\beta_2$; and, said forward flank and said partition line defining a flank angle $\beta_1$ greater than said angle $\beta_2$, said second section being in flat contact engagement with the tooth flank corresponding thereto and said forward flank being in point contact engagement with the tooth flank adjacent thereto so as to cause said forward flank and the adjacent tooth flank to conjointly define a wedge gap Kv therebetween thereby defining said first position of said drive link, said wedge gap Kv facing inwardly toward said lowermost point.

4. The saw chain of claim 3, said first flank section and the tooth flank adjacent thereto conjointly defining an outwardly opening wedge gap Kr in said first position of said drive link.

5. The saw chain of claim 3, said one drive-link flank having a third flank section nearer to said lowermost point than said first and second flank sections, said third section being convex.

6. The saw chain of claim 5, said one tooth having a forward tooth flank facing in the direction of movement of the saw chain, said first and second flank sections being linear and said second flank section and said partition line conjointly defining a flank angle $\beta_3$, said flank angle $\beta_2$ and said flank angle $\beta_3$ both being dimensioned so as to cause said drive link to be in contact engagement with said forward tooth flank at said second flank section when said drive link is in said first position and so as to cause said drive link to be in contact engagement with said forward tooth flank at said first flank section when said drive link is in said second position.

7. The saw chain of claim 5, said first, second and third flank sections being disposed one behind the other so as to define a continuous uninterrupted transition in the respective slopes thereof.

8. The saw chain of claim 7, said first and second flank sections being directly next to each other.

9. The saw chain of claim 3, the sum of said flank angle $\beta_1$ and said flank angle $\beta_2$ being equal to said opening angle $\gamma$ of said tooth gap.

10. The saw chain of claim 1, wherein each of said cutting links is so aligned that a connecting line between said forward and rearward cutting-link pivot axes is at right angles to a plane of symmetry of said one tooth of said nose sprocket when said drive link is in said first position, said plane of symmetry intersecting said connecting line mid way between said cutting-link pivot axes.

11. The saw chain of claim 10, said drive links and said connecting links being pivotally movable about said pivot axes without play.

* * * * *